US006695371B1

(12) United States Patent
Simkins

(10) Patent No.: US 6,695,371 B1
(45) Date of Patent: Feb. 24, 2004

(54) CONTAINER ATTACHMENT DEVICE

(75) Inventor: Nelson Simkins, Rittman, OH (US)

(73) Assignee: Joseph S. Kanfer, Richfield, OH (US)

( * ) Notice: Subject to any disclaimer, the term of this patent is extended or adjusted under 35 U.S.C. 154(b) by 0 days.

(21) Appl. No.: 10/138,815

(22) Filed: May 6, 2002

(51) Int. Cl.[7] ..... A45F 5/00; B65D 23/10

(52) U.S. Cl. ..... 294/33; 224/148.4; 294/27.1

(58) Field of Search ..... 294/27.1, 31.2, 294/33, 90, 92, 137, 149; 224/148.1, 148.4, 148.5, 148.7; 215/395, 396, 399

(56) References Cited

U.S. PATENT DOCUMENTS 1,377,350 A * 5/1921 Hoskin ..... 294/33
1,825,897 A * 10/1931 Brooke ..... 294/31.2
5,577,647 A * 11/1996 Pittarelli et al. ..... 224/148.6
5,695,232 A * 12/1997 Tipp ..... 294/87.2
6,279,794 B1 * 8/2001 Miyazaki ..... 224/148.7

OTHER PUBLICATIONS

Printout from website located at http://www.sprixx.com/product.html (accessed on Apr. 5, 2002).

* cited by examiner

*Primary Examiner*—Dean J. Kramer
(74) *Attorney, Agent, or Firm*—Renner, Kenner, Greive, Bobak, Taylor & Weber

(57) ABSTRACT

An attachment assembly for attaching a container to a support, such as a tether or lanyard, includes a flexible body releasably attachable to the neck of the container and a flexible clip disposed on the body for releasable attachment to the support. A plate also depends from the body of the assembly for engagement with the body of the container.

3 Claims, 2 Drawing Sheets

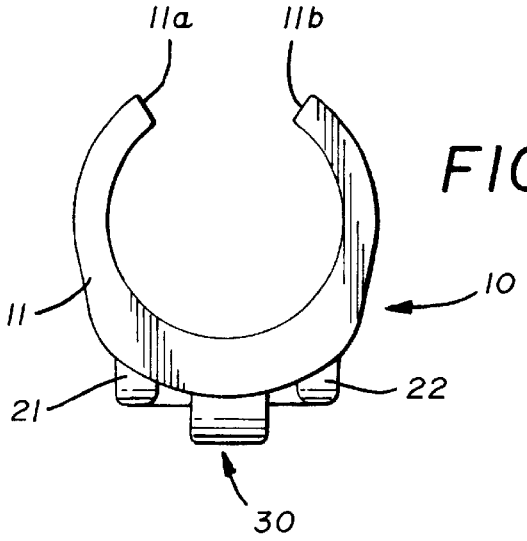
FIG. 3
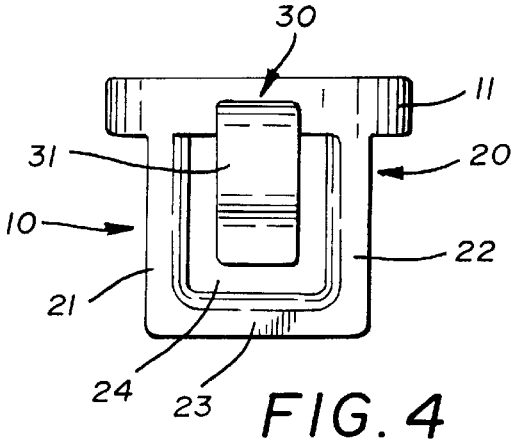
FIG. 4
FIG. 5
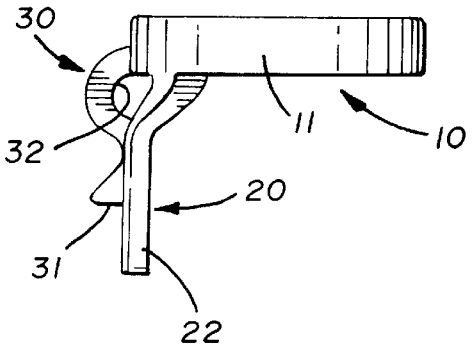
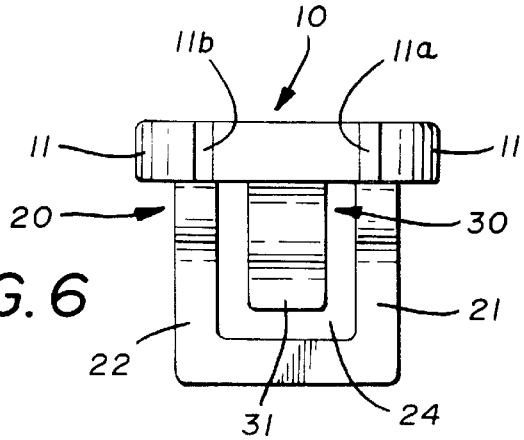
FIG. 6

CONTAINER ATTACHMENT DEVICE

RELATED PATENT APPLICATIONS

This application is also the subject of a design Pat. No. D476,569, filed on May 7, 2002 and entitled bottle attachment clip.

FIELD OF THE INVENTION

This invention relates in general to an attachment assembly for releasably interconnecting two objects and, in particular, relates to a device for interconnecting a container to a supporting element such as a lanyard or tether.

BRIEF DESCRIPTION OF THE PRIOR ART

It has been long known that various cleansing preparations, such as soaps, lotions, antibacterial and antimicrobial materials, can be packaged and dispensed in various ways for use by the ultimate user.

Some of these approaches involve counter-mounted bottles or containers, and wall-mounted dispensers. In some instances, however, the same products can be packaged in small containers containing small amounts of the product and intended to be carried on the person of the user. These containers are often carried in the pocket of the user's apparel or, alternatively, received in a holster or a similar holding device which can be mounted on the belt, for example. The contents are also dispensed from the container in various ways such as by some sort of pump or by simply opening and inverting the container.

However, it has also been found that it would be desirable to provide these smaller containers in a more readily accessible position on the body of the user, such as, from the neck of the user so that they would be readily accessible without disengaging them from any securing device or, alternatively, used with the container mounted on the supporting member, such as, a lanyard, etc.

It is accordingly, the principal object of this invention to provide a means for interconnecting a supporting device or element worn from the neck of the ultimate user and the bottle from which the contents can be dispensed.

SUMMARY OF THE INVENTION

It has been found that a suitable device for interengaging a lanyard, tether or other support element, worn on the person of the end user, with the container can be provided by providing a flexible clip made out of suitable resilient or flexible material such as various types of plastic which can engage the neck of the bottle or container and an engagement member secured to the clip for attachment to the lanyard or tether.

It has been further found that the objects of the invention can be further achieved by providing a positioning plate depending from the ring of the engagement clip to abut a side surface of the container so as to keep the container oriented in the desired condition.

Accordingly, production of an improved bottle attachment device with the character above-described becomes the principal object of this invention with other objects thereof becoming more apparent upon a reading of the following brief specification considered and interpreted in view of the accompanying drawings.

BRIEF DESCRIPTION OF THE DRAWINGS

FIG. 3 is a top plan view of the improved device.

FIG. 4 is a front elevational view thereof.

FIG. 5 is a side elevational view thereof.

FIG. 6 is a rear elevational view thereof.

BRIEF DESCRIPTION OF THE PREFERRED EMBODIMENTS

Figure 2:
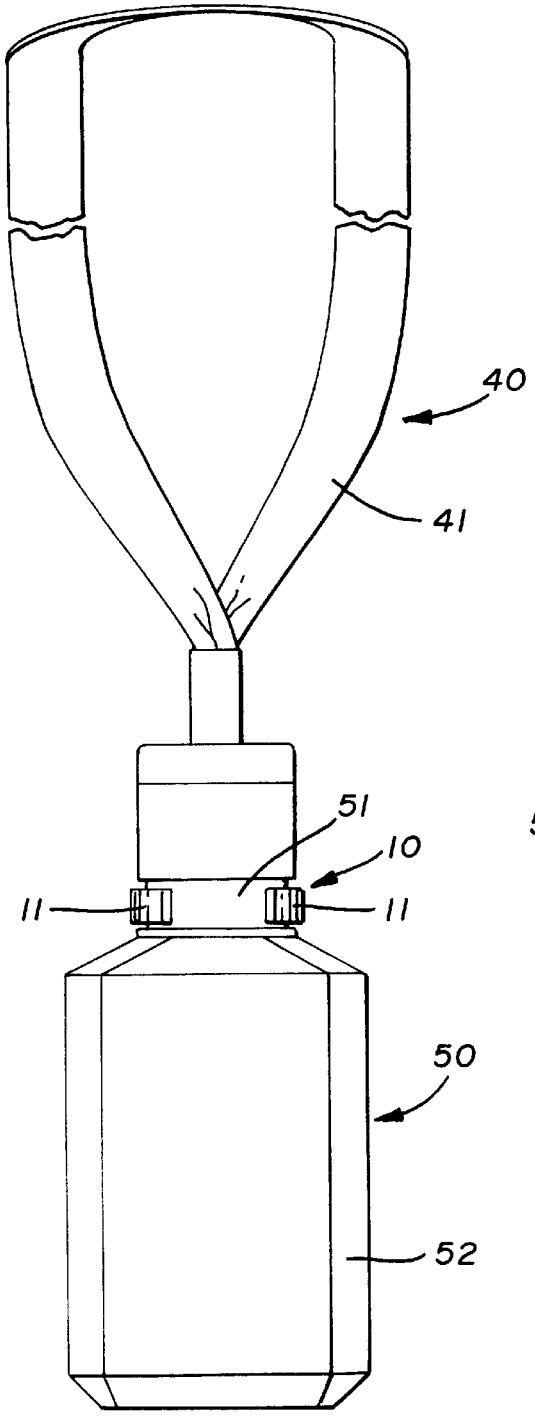
FIG. 2 is a rear elevational view of the improved bottle attachment device again attached to a supporting lanyard.
Figure 1:
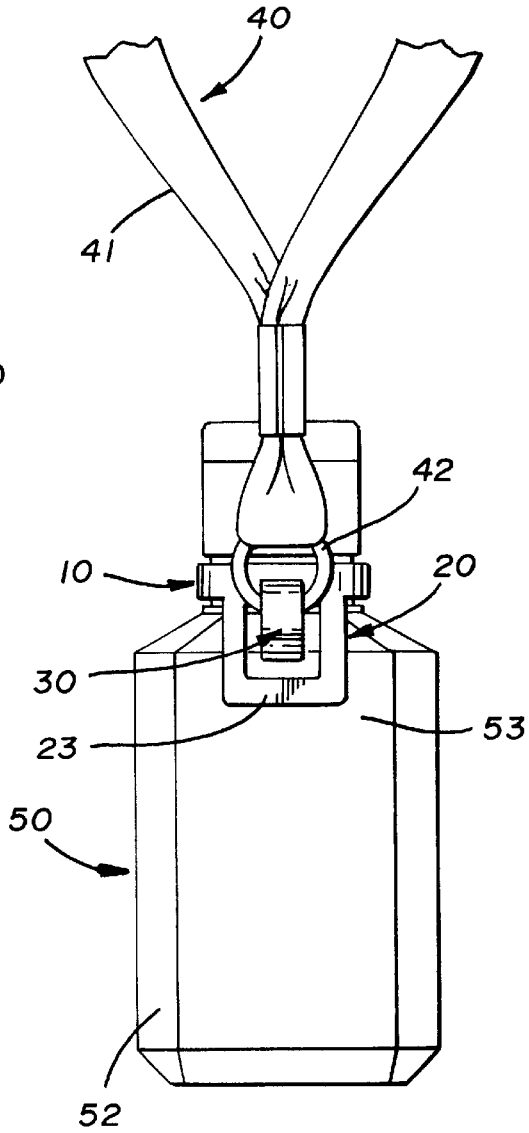
FIG. 1 is a front elevational view of the improved device attached to a supporting lanyard.

Referring first to FIGS. 1 and 2 of the drawings, it will be noted that the improved bottle attachment device is generally indicated by the numeral 10, while the container is generally indicated by the numeral 50 and the supporting element such as a lanyard or tether is generally indicated by the numeral 40.

Referring next then to FIG. 3 of the drawings, for a more detailed description of the improved container attachment device 10, it will be noted that a ring 11 is provided with this ring being flexible and fabricated of a suitable material such as plastic, for example. It will be understood that the invention is not intended to be limited to any specific material so long as the ring is constructed of material which has sufficient flexibility to snap around the neck of the container 50 as will be described.

Still referring to FIG. 3 of the drawings, it will be noted that the ring 11 presents a generally circular configuration when viewed in plan, although it actually forms an interrupted circle in that the ends 11*a* and 11*b* are terminated so as to form an opening between the ends 11*a* and 11*b* for ultimate engagement with the neck of the container 50.

As can be seen in FIG. 4 of the drawings, an engagement element or means 20 depends from the ring 11 and in the preferred embodiment of the invention, it would be molded integrally therewith, although it could be a separate element and otherwise secured to the ring 11. This element includes depending legs 21 and 22 which are interconnected by a bottom leg 23 so as to form an opening 24 as can be seen in FIGS. 4 and 6 of the drawings.

At this point it will be seen that the flexible ring 11 is capable of being snapped around the neck 51 of the container 50 and that the engagement element 20 will then bear against a wall or surface 53 of the body 52 of the container 50. This assures that the orientation of the bottle is fixed, so long as the tether 40 and the container 50 are interconnected by the clip 20.

Referring to FIGS. 4 and 5 of the drawings, it will be seen that also depending from a peripheral wall of the ring 11 is an attachment element 30. This attachment element again is preferably molded integrally with the ring 11, although it too could be fixed to the ring in other fashions. The attachment element 30 has a body 31 which, as noted, does depend from the peripheral wall of the ring 11 and is generally S-shaped in elevation. The result is to form an opening 32, and it is to be noted that the attachment element 30 is also intended to be flexible.

The conventional lanyard 40 consists of a neck engaging portion 41, as shown in FIGS. 1 and 2 of the drawings, and generally an attachment ring 42 depending from the neck engaging member. As can be seen in FIGS. 1 and 5 of the drawings, the opening 32 in the attachment element 30 is capable to releasably engaging this ring.

In use or operation of the improved bottle attachment device, it can be seen that the ring 11 will first be snapped over the neck 51 of the container 50, with engagement element 20 abutting the container and then the ring 42 of the lanyard 40 can be engaged with the attachment element 30. In this fashion, the container is readily accessible to the user who can either operate it or dispense the contents without removing it or simply snap the ring 11 off the neck 51 of the container. Alternatively, one could simply disengage the ring 42 of the lanyard 40 from the attachment element 30 and utilize the container to dispense its contents in that fashion.

While a full and complete description of the invention has been set forth in accordance with the dictates of the Patent Statutes, it should be understood that modifications can be resorted to without departing from the spirit hereof or the scope of the appended claims.

Thus while a particular configuration for engagement element 20 has been illustrated and described, that element could take other forms so long as it has a configuration which maintains the orientation of the container.

What is claimed is:

1. A device for releasably interconnecting a container having a body and neck portion projecting therefrom one end thereof to a supporting element comprising:

a) a flexible clip for releasable connection with the neck of the container and with the supporting element;

b) engagement means carried by the flexible clip for engaging the body portion of the container;

c) an attachment element depending from said flexible clip for releasable engagement with the supporting elements;

d) said engagement means including a plate depending from said flexible clip for engagement with the body of the container; and e) said plate comprising opposed, spaced legs depending from the flexible clip and a cross member joining the distal ends of said legs to form an opening between the clip, the spaced legs and the cross member; and said attachment element extends from said clip into said opening.

2. A device for releasably interconnecting a container having a body and a neck portion projecting from one end thereof to a supporting element comprising:

a) a flexible clip for releasable connection with the neck of the container and with the supporting element;

b) engagement means carried by said flexible clip for engaging the body portion of the container;

c) said flexible clip having a generally circular configuration when viewed in plan and forms an interrupted ring for frictional engagement with the neck portion of the container; and d) an attachment element depending from said flexible clip for releasable engagement with the supporting element.

3. A device for releasably interconnecting a container having a body and a neck portion projecting from one end thereof to a supporting element comprising:

a) a flexible clip for releasable connection with the neck of the container and with the supporting element;

b) engagement means carried by said flexible clip for engaging the body portion of the container;

c) said flexible clip having a generally circular configuration when viewed in plan and forms an interrupted ring for frictional engagement with the neck portion of the container;

d) said engagement means including a plate depending from said flexible clip for engagement with the body of the container when said ring is in engagement with the neck portion of the container;

e) said plate comprises opposed spaced legs depending from said flexible clip and a cross member joining distal ends of said legs to form an opening between said clip, said spaced legs and said cross member; and f) an attachment element depending from said flexible clip for releasable engagement with the supporting element said attachment element extends from said clip into said opening.

* * * * *